US007455010B2

(12) United States Patent
Westendorf et al.

(10) Patent No.: US 7,455,010 B2
(45) Date of Patent: Nov. 25, 2008

(54) EXPANDED BARREL HYDRAULIC CYLINDER ASSEMBLY

(75) Inventors: Neal W. Westendorf, Dakota Dunes, SD (US); Joseph W. Langenfeld, Onawa, IA (US)

(73) Assignee: Westendorf Manufacturing Co., Inc., Onawa, IA (US)

( * ) Notice: Subject to any disclaimer, the term of this patent is extended or adjusted under 35 U.S.C. 154(b) by 0 days.

(21) Appl. No.: 11/355,683

(22) Filed: Feb. 16, 2006

(65) Prior Publication Data

US 2007/0186765 A1 Aug. 16, 2007

(51) Int. Cl.
*F01B 29/00* (2006.01)
*F15B 15/00* (2006.01)

(52) U.S. Cl. ..... 92/128; 92/165 R; 92/169.1

(58) Field of Classification Search ..... 92/128, 92/165 R, 169.1, 168
See application file for complete search history.

(56) References Cited

U.S. PATENT DOCUMENTS

| | | | | |
|---|---|---|---|---|
| 3,334,773 | A | 8/1967 | Bimba | |
| 3,650,182 | A * | 3/1972 | Phillips | 92/128 |
| 3,730,057 | A * | 5/1973 | Friden | 92/168 |
| 3,881,401 | A | 5/1975 | Bimba | |
| 4,192,225 | A * | 3/1980 | Moyer | 92/169.1 |
| 4,303,005 | A | 12/1981 | Glomski | |
| 4,627,332 | A | 12/1986 | Furuta | |
| 4,781,024 | A | 11/1988 | Nakamura | |
| 4,884,665 | A | 12/1989 | Parker | |
| 4,924,758 | A * | 5/1990 | Yuda | 92/128 |
| 4,936,197 | A | 6/1990 | Brent | |
| 5,487,326 | A | 1/1996 | Owens | |
| 5,715,740 | A * | 2/1998 | Sims | 92/128 |
| 6,263,779 | B1 * | 7/2001 | Oliver et al. | 92/128 |
| 6,439,103 | B1 * | 8/2002 | Miller | 92/128 |
| 7,100,492 | B2 * | 9/2006 | Fish | 92/128 |

* cited by examiner

*Primary Examiner*—Thomas E Lazo
(74) *Attorney, Agent, or Firm*—Dowell Baker, P.C.

(57) ABSTRACT

The hydraulic cylinder assembly of the present invention provides an enlarged barrel and a compressible locking ring that secure a rod gland in the rod end of the cylinder. The tapered barrel prevents the rod gland from sliding into the cylinder and the locking ring seated in an annular groove prevents the rod gland from sliding out of the cylinder. A small hole in the cylinder barrel is provided through which the round ring may be punched out of the annular groove and easily removed with a screwdriver or pick. These features allow the hydraulic cylinder to be easily assembled and disassembled without compression tools and eliminate the need for threaded components, welds or bolts. The enlarged rod end of the cylinder barrel also provides a smooth cylinder barrel that is elegant in appearance and more easily manufactured, repaired and maintained.

15 Claims, 3 Drawing Sheets

FIG. 1
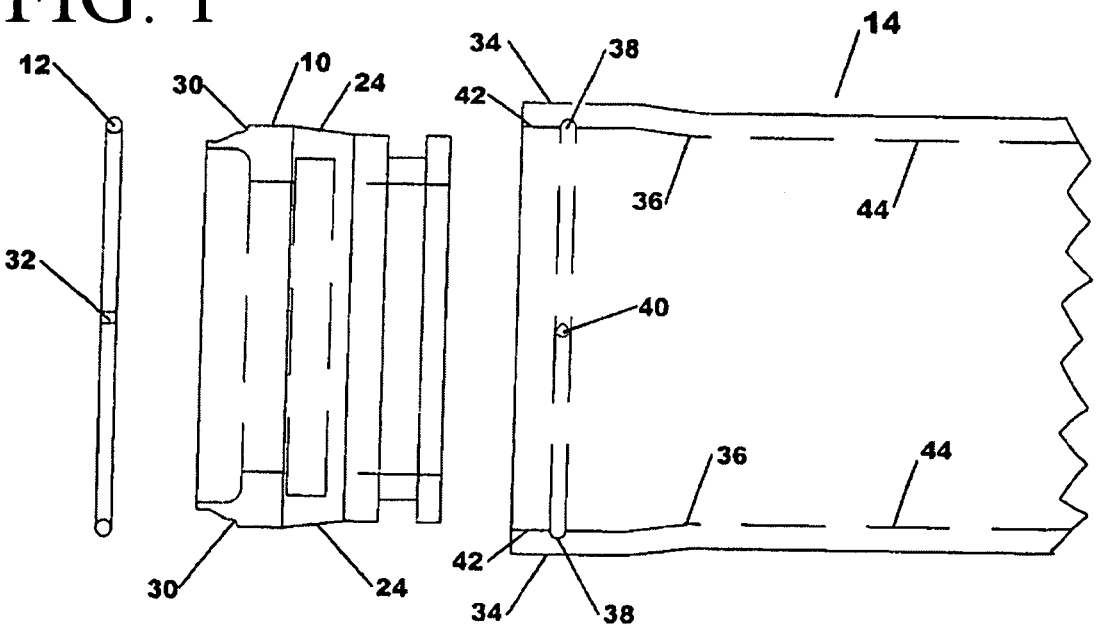
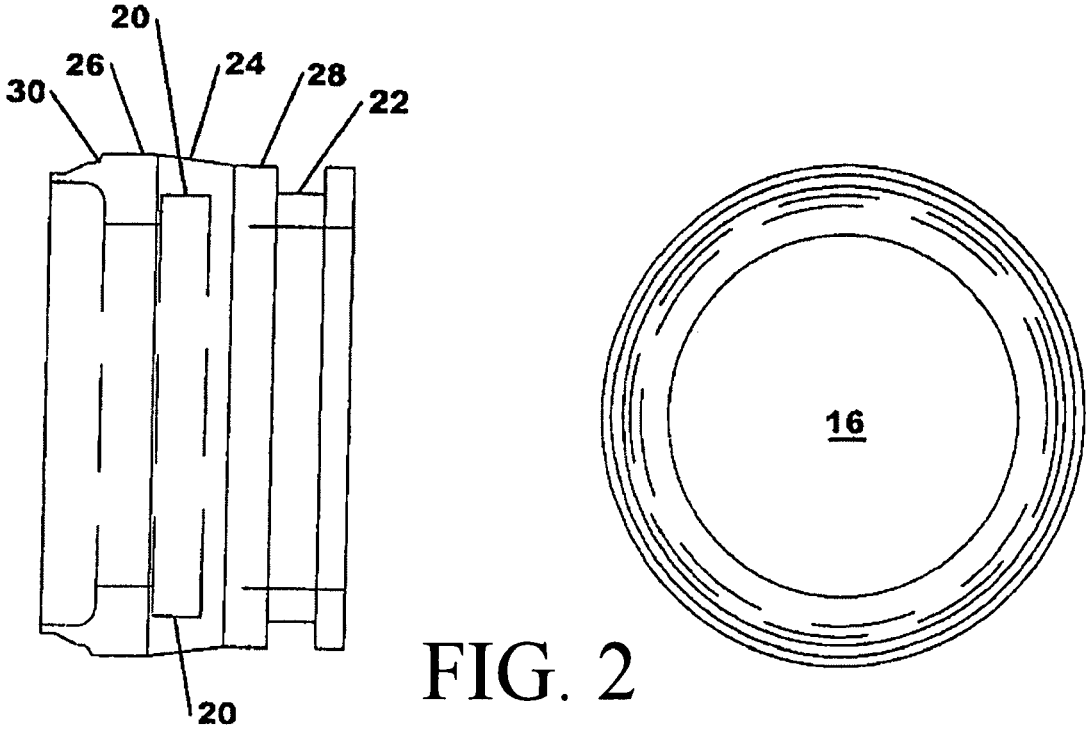
FIG. 2

FIG. 3
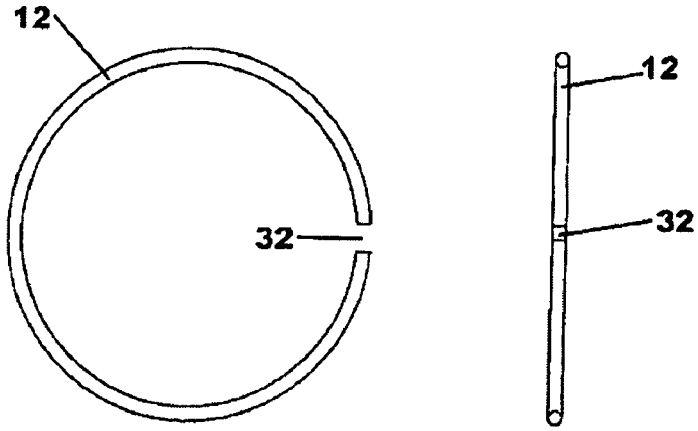
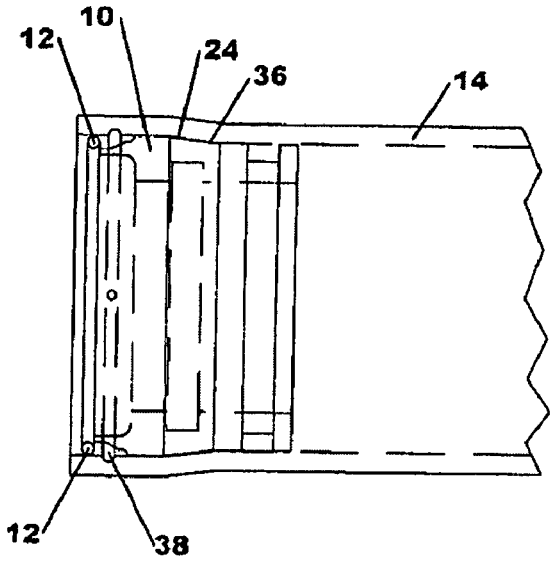
FIG. 4
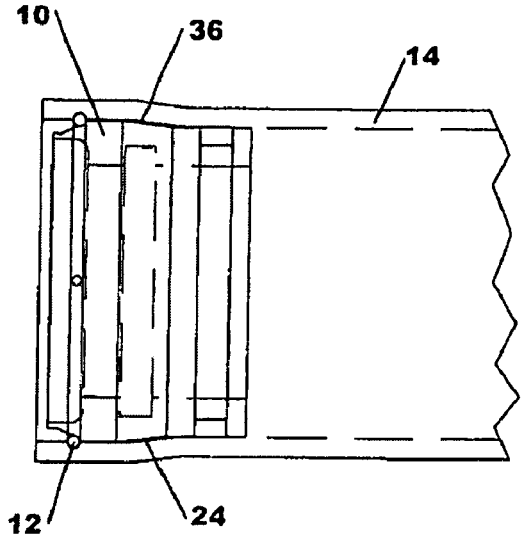
FIG. 5

EXPANDED BARREL HYDRAULIC CYLINDER ASSEMBLY

FIELD OF THE INVENTION

The present invention relates generally to hydraulic cylinders, and more specifically to a rod gland assembly and construction for the piston rod end of a hydraulic cylinder assembly.

BACKGROUND OF THE INVENTION

Hydraulic cylinders are commonly used to deliver reciprocating linear forces in a wide variety of mechanical applications. The essential components of a hydraulic cylinder include a cylinder barrel, a piston that moves linearly within the cylinder barrel, a pressurized hydraulic fluid sealed within the cylinder barrel that activates the movement of the piston, a piston rod attached to the piston that delivers a reciprocating, linear force as the piston is moved within the cylinder barrel, a blind end cap or other closure that seals and contains the hydraulic fluid on the blind end of the cylinder barrel and a rod end assembly that seals and contains the hydraulic fluid on the rod end of the cylinder barrel but also allows the piston rod to reciprocate freely through the rod end of the cylinder barrel.

A rod gland is typically utilized in the rod end of the cylinder to seal the end of the barrel. The rod gland must be prevented from either slipping out of or farther into the cylinder barrel. Many configurations for holding the rod gland in place have been utilized. The rod gland may be held in place by a gland nut or collar that is screwed, welded or otherwise secured to the rod end of the barrel. Although widely employed, these configurations have inherent weaknesses.

In configurations where the gland nut is screwed to the barrel, the outside of the cylinder barrel must be machined to create threads, which is an expensive operation that may also weaken the barrel. In addition, hydraulic cylinders are subject to vibration and other forces that can, over a period of time, cause threaded components to unscrew. Threaded metal components can also be difficult to engage and disengage. The threads can be stripped, which can ruin the components or lead to expensive remachining operations. Threaded metal components may also rust or corrode, making it difficult to remove the gland nut.

In configurations where the gland nut is welded to the barrel, the cylinder barrel may be damaged or distorted by the heat of the welding operation. Seals within the cylinder barrel can also be damaged by the heat of welding on the exterior of the barrel. Further, once the gland nut is welded to the barrel, it cannot be easily removed and seals and components within the barrel cannot be easily accessed for repair or replacement.

Also, whether screwed or welded to the rod end of the cylinder barrel, the gland nut adds significant bulk to the rod end of the hydraulic cylinder, and creates a snag point and protrusion on an otherwise streamlined cylinder. In certain applications, this additional bulk on the end of the cylinder can be a significant disadvantage.

In addition to preventing the rod gland from sliding out of the cylinder barrel, the rod gland must also be prevented from sliding farther into the cylinder barrel. Tapered or enlarged cylinder barrels have been developed that prevent the rod gland from sliding into the cylinder, but these configurations have been overly complex or otherwise inadequate. U.S. Pat. No. 5,715,740 issued to Sims utilizes a tapered cylinder barrel coupled with a threaded retaining ring that engages threads on the interior of the barrel. This configuration, however, is complex to machine, difficult to disassemble and requires the use of specialized tools to assemble and disassemble. U.S. Pat. No. 3,881,401 issued to Bimba also employs a threaded end member that engages threads on the interior of the cylinder barrel. The threaded end member is held in place by a spring wire member that secures the threaded end member in place.

These configurations, however, require that the interior of the barrel be machined to create threads, which is an expensive machining process and can compromise the integrity of the barrel. The threaded components also can become stripped or cross-threaded, leading to problems with the assembly and disassembly of the hydraulic cylinder. Further, the interior threads create sharp snag points on the interior of the barrel that can damage seals on the rod gland when the rod gland is inserted into or removed from the barrel.

Another use of a tapered or enlarged barrel is disclosed in U.S. Pat. No. 4,085,661 issued to Schriever. In this configuration, despite the use of an enlarged barrel, the rod gland is secured to both a gland nut and the cylinder barrel. In particular, a plurality of wedge-shaped locking segments are bolted to the cylinder barrel and an annular cap is bolted to the rod gland with locking bolts. Locking bolts, however, may become loose due to vibration or other forces, suffer from cross-threading and stripping problems, create additional complexity for the rod end assembly and protrude from the cylinder to create additional snag points. This solution is therefore not optimal.

Accordingly, an object of the present invention is to provide an improved hydraulic cylinder with a streamlined cylinder barrel free of protrusions and snag points.

A further object of the present invention is to provide an improved hydraulic cylinder that eliminates the need for a gland nut or collar to hold the rod gland in place.

Another object of the present invention is to provide an improved hydraulic cylinder without threaded components, thereby preventing the possibility that the components could become unscrewed during use of the hydraulic cylinder and eliminating other problems associated with threaded components.

An additional object of the present invention is to provide an improved hydraulic cylinder that may be assembled without welding any of the components.

A still further object of the present invention is to provide an improved hydraulic cylinder that may be easily assembled and disassembled without special tools.

Yet another object of the present invention to provide an improved hydraulic cylinder without snag points on the interior of the rod end of the barrel to prevent damage to seals when the rod gland is inserted into or removed from the barrel.

Finally, an object of the present invention is to provide an improved hydraulic cylinder that is economical to manufacture and refined in appearance.

SUMMARY OF THE INVENTION

The preferred embodiment of the present invention provides an improved hydraulic cylinder assembly that utilizes a cylinder barrel with an expanded, enlarged or outwardly tapered rod end. A rod gland inserts into the enlarged rod end and is prevented from sliding farther into the cylinder barrel by the taper of the barrel. The rod gland is held in place by a round ring that seats in an annular groove on the interior of the barrel.

The rod gland may be easily inserted into the barrel and securely held in place by simply snapping the round locking ring into the annular groove. A small hole in the cylinder barrel is also provided through which the round ring may be punched out of the annular groove and easily removed with a screwdriver or pick. These features allow the hydraulic cylinder to be easily assembled and disassembled without special tools and eliminate the need for threaded components, welds or bolts.

The tapered rod end of the cylinder barrel, which is enlarged by swedging or other manufacturing process, provides increased strength for the cylinder as compared to cylinders that have been machined to create a tapered portion. The present invention also avoids the use of threads on either the inside or the outside of the cylinder barrel. Further, because square cut grooves on the interior of the cylinder barrel can compromise and weaken the barrel, as well as create snag points for rod gland seals as they are inserted into or removed from the cylinder, the present invention utilizes a rounded annular groove on the interior of the cylinder to hold the round ring in place. Thus, the seals of the rod gland do not pass over threads or sharp corners when the gland is inserted into or removed from the cylinder barrel, decreasing the potential for damaging the rod gland seals. Also, when inserted into or removed from the cylinder barrel, the seals of the rod gland encounter less resistance from the expanded portion of the barrel, thus preventing damage to the seals during assembly or disassembly. The expanded end of the barrel also increases the size of the round locking ring, proving increased holding power.

These and other advantages will become apparent as this specification is read in conjunction with the accompanying drawings and appended claims.

BRIEF DESCRIPTION OF THE DRAWINGS

FIG. 1 is a side view of the rod end assembly of the present invention including the rod gland, locking ring and the rod end of the cylinder barrel.

FIG. 2 is a side view and an end view of the rod gland of the present invention.

FIG. 3 is a side view and an end view of the locking ring of the present invention.

FIG. 4 is a side view of the rod end assembly of the present invention with the rod gland inserted in the cylinder barrel and the locking ring ready to be locked into place.

FIG. 5 is a side view of the rod end assembly of the present invention with the locking ring locked into place to hold the rod gland in the cylinder barrel.

Figure 6:
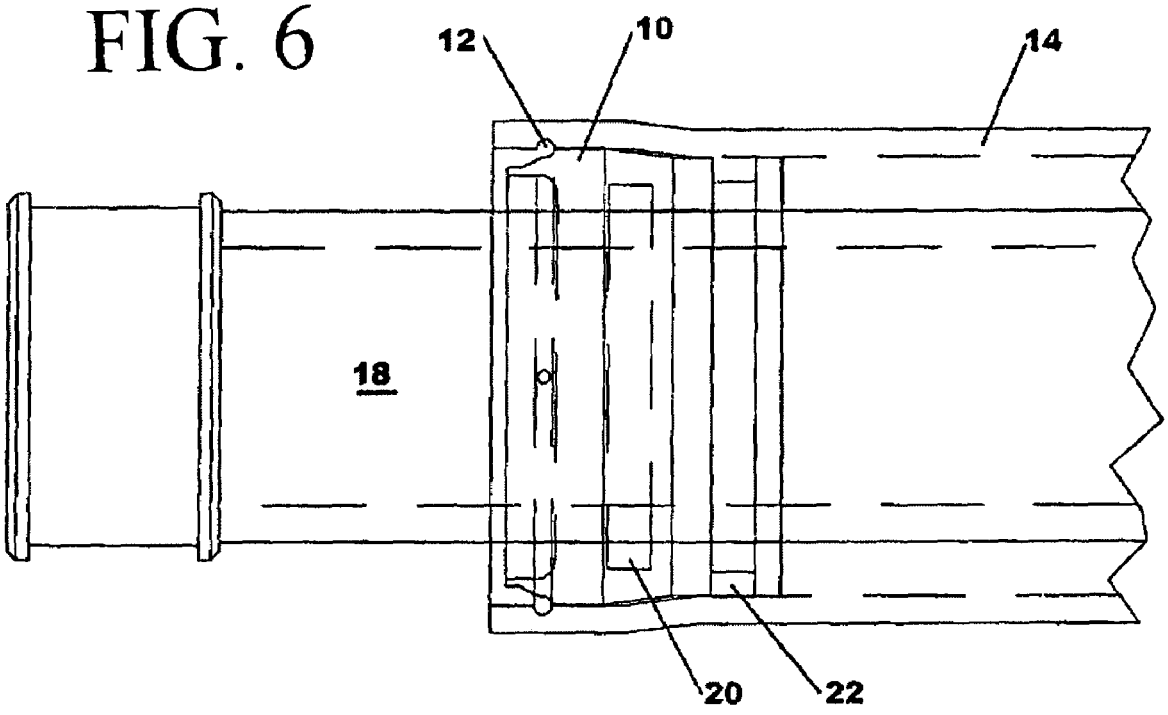
FIG. 6 is a side view of the rod end assembly of the present invention also showing the piston rod that travels through the rod gland.

The drawings are not necessarily to scale and certain details unnecessary for an understanding of the present invention have been omitted. The invention is not limited to the particular embodiments illustrated herein.

DETAILED DESCRIPTION

FIG. 1 shows the key components of the rod end assembly of the present invention including the rod gland 10, the locking ring 12 and the rod end of the cylinder barrel 14. Other well known components of a hydraulic cylinder are not shown including a piston that moves linearly within the cylinder barrel, a blind end cap on the opposite end of the cylinder and components for pressurizing and directing the flow of hydraulic cylinder within the barrel. These components are not essential for an understanding of the present invention and have therefore been omitted from this disclosure. Those of skill in the art will understand that the rod end assembly of the present invention can be used with most any of the well-known configurations for hydraulic cylinders and is compatible with most all hydraulic cylinder components.

The rod gland 10 can be seen in greater magnified detail in FIG. 2, which includes both a side view and an end view of the rod gland. The rod gland 10 includes a bore 16 through the rod gland which, as will be described, allows for a piston rod 18 to pass through the rod gland. The rod gland 10 also includes an inner annular groove 20 on the inside of the rod gland and an outer annular groove 22 on the outside of the rod gland. The outside of the rod gland 10 also includes a tapered outer surface 24 that provides a transition from the first outer surface 26 of greatest circumference to the second outer surface 28 of lesser circumference. In addition, the rod gland 10 includes an outer locking ring receiving groove 30 adjacent to the first outer surface 26.

The locking ring 12 can be seen in greater magnified detail in FIG. 3, which includes both a side view and an end view of the locking ring. The locking ring 12 preferably has a circular cross section, which allows the ring to be more easily inserted into and removed from its locking position. However, a locking ring with a square cross section (or other shape) may also be used and remain within the spirit and scope of the present invention.

Because the locking ring 12 is a C shaped ring with a portion 32 removed from the circumference of the ring, the locking ring may be compressed to decrease the circumference of the ring. As will be described further herein, the compression of the locking ring allows it to be easily inserted into and removed from its locking position.

Referring back to FIG. 1, the rod end of the cylinder barrel 14 includes an expanded or enlarged end 34. The expanded rod end 34 of the cylinder barrel 14 may be enlarged by swedging or other known manufacturing process. This process creates a tapered inner surface 36 on the interior of the cylinder barrel 14 that provides a transition from the first inner surface 42 of greatest circumference to the second inner surface 44 of lesser circumference. On the exterior of the cylinder, the enlarged end 34 is only slightly greater in circumference than the remainder of the cylinder barrel 14, creating a hydraulic cylinder with a smooth exterior circumference without snag points or protrusions.

The cylinder barrel 14 also includes an inner cylinder groove 38 around the inner circumference and near the end of the barrel. The inner cylinder groove 38 is adapted for reception of the locking ring 12. The inner cylinder groove 38 is preferably rounded, rather than square, to eliminate square corners or grooves on the interior of the barrel that can compromise the physical integrity of the barrel. A rounded inner cylinder groove 38 also avoids square corner snag points that can damage seals when the rod gland 10 is inserted into and removed from the cylinder barrel 14. A rounded inner cylinder groove 38 is also provided to accept a locking ring 12 with a round cross section so that the locking ring can more easily be inserted into and removed from the cylinder. However, a locking ring with a square cross section (or other shape) may also be used and remain within the spirit and scope of the present invention.

The cylinder barrel 14 also has a small hole 40 through the cylinder barrel 14 at the location of the inner cylinder groove 38. Additional holes may also be provided. The hole 40 allows the locking ring 12 to be easily displaced from the inner cylinder groove 38 with a simple pick or punching tool so that the rod gland 10 may be removed from the cylinder barrel 14.

The assembly of the present invention is shown in FIGS. 4 and 5. Referring to FIG. 4, the rod gland 10 is inserted into the rod end of the cylinder barrel 14 until the tapered outer surface 24 of the rod gland abuts the tapered inner surface 36 of the cylinder barrel. In this position, the rod gland 10 is prevented from sliding any farther into the cylinder barrel 14 by the abutting tapered surfaces 24 and 36. The locking ring 12 is then compressed and placed in the end of the cylinder barrel 14.

Then, as shown in FIG. 5, the locking ring is tapped farther into the cylinder 14 over the outer end of the rod gland 10 until it snaps into the inner cylinder groove 38. The rod gland 10 is then allowed to slide slightly out of the cylinder 14 until the outer locking ring receiving groove 30 of the rod gland engages the locking ring 12. The rod gland 10 is prevented from moving farther out of the cylinder 14 by the locking ring 12.

To remove the rod gland 10 from the cylinder 14, the rod gland is tapped to cause it to slide slightly into the cylinder until the tapered surfaces 24 and 36 abut. In this position, the locking ring may be dislodged from the inner cylinder groove 38 by tapping or punching the locking ring through the hole 40. Once dislodged from the inner cylinder groove 38, the locking ring 12 may be easily removed from the end of the barrel 14 with a pick or screwdriver. The rod gland 10 may then be slid out of the barrel 14.

Thus, the rod gland assembly of the present invention may be easily assembled and disassembled with readily available tools and with minimal trouble. This feature allows for the components of the hydraulic cylinder, including the seals, to be easily inspected, repaired and replaced, increasing the safety of the hydraulic cylinder. The cost of repairing the cylinder is also decreased, especially compared to hydraulic cylinders that cannot be easily disassembled and that must be entirely replaced when their internal seals become worn or damaged. The present invention also entirely avoids the use of threaded metal components and the problems noted above associated with such components.

The assembled rod gland assembly, complete with a piston rod 18 inserted through the bore 16 of the rod gland 10, is shown in FIG. 6. Seals (not shown) are also preferably provided in the inner annular groove 20 and outer annular groove 22 of the rod gland 10. The seal in the inner annular groove 20 prevents hydraulic fluid from escaping from the cylinder 14 between the rod gland 10 and the piston rod 18. The seal in the outer annular groove 22 prevents hydraulic fluid from escaping from the cylinder between the rod gland 10 and the cylinder 14.

Other alterations, variations, and combinations are possible that fall within the scope of the present invention. Although the preferred embodiments of the present invention have been described, those skilled in the art will recognize other modifications that may be made that would nonetheless fall within the scope of the present invention. Therefore, the present invention should not be limited to the apparatus and method described. Instead, the scope of the present invention should be consistent with the invention claimed below.

What is claimed is:

1. A hydraulic cylinder, the hydraulic cylinder comprising:

a cylinder barrel having a rod end, a blind end and pressurized hydraulic fluid sealed within the cylinder barrel;

a piston adapted for linear movement within the cylinder barrel;

a piston rod attached to the piston and exiting the rod end of the cylinder barrel, the piston rod delivering a reciprocating, linear force as the piston is moved within the cylinder barrel;

a blind end closure sealing the blind end of the cylinder barrel;

a rod gland inside the cylinder barrel and adjacent the rod end of the cylinder barrel to seal the rod end of the cylinder barrel and to allow for movement of the piston rod through the rod gland;

the cylinder barrel further having a portion of greater interior circumference adjacent the rod end of the cylinder barrel and an annular groove on the interior of the cylinder barrel within the portion of greater interior circumference;

a compressible locking ring adapted for reception in the annular groove to prevent the rod gland from exiting the cylinder barrel; and the cylinder barrel further including a hole through the cylinder barrel at the annular groove to allow the compressible locking ring to be dislodged from the annular groove.

2. The hydraulic cylinder of claim 1 wherein the rod gland has a portion of greater exterior circumference that abuts the portion of greater interior circumference of the cylinder barrel.

3. The hydraulic cylinder of the claim 1 wherein the cylinder barrel has a uniform thickness.

4. The hydraulic cylinder of claim 1 wherein the compressible locking ring has a portion with a substantially circular cross section.

5. The hydraulic cylinder of claim 1 wherein the compressible locking ring has a portion with a substantially rectangular cross section.

6. The hydraulic cylinder of claim 1 wherein the compressible locking ring has a C-shape.

7. A hydraulic cylinder, the hydraulic cylinder comprising:

a cylinder barrel having an enlarged rod end, a blind end and pressurized hydraulic fluid sealed within the cylinder barrel;

a piston adapted for linear movement within the cylinder barrel;

a piston rod attached to the piston and exiting the rod end of the cylinder barrel, the piston rod delivering a reciprocating, linear force as the piston moves within the cylinder barrel;

a blind end closure sealing the blind end of the cylinder barrel;

a rod gland inside the cylinder barrel and adjacent the rod end of the cylinder barrel to seal the rod end of the cylinder barrel and to allow for movement of the piston rod through the rod gland, the rod gland having a first outer surface of greatest circumference, a second outer surface of lesser circumference and a tapered outer surface between the first outer surface and the second outer surface;

the enlarged rod end of the cylinder barrel having a tapered inner surface on the interior of the cylinder barrel and a tapered outer surface on the exterior of the cylinder barrel;

the tapered outer surface of the rod gland abutting against the tapered inner surface of the tapered rod end to prevent the rod gland from moving farther inside the cylinder barrel; and a compressible locking ring inside the cylinder barrel that prevents the rod gland from exiting the cylinder barrel, the compressible locking ring having a C-shape.

8. The hydraulic cylinder of claim 7 wherein the cylinder barrel further includes a hole through the cylinder barrel to allow the compressible locking ring to be dislodged so that the rod gland may be removed from the cylinder barrel.

9. The hydraulic cylinder of claim 7 wherein the compressible locking ring has a portion with a substantially circular cross section.

10. The hydraulic cylinder of claim 7 wherein the compressible locking ring has a portion with a substantially rectangular cross section.

11. The hydraulic cylinder of claim 7 wherein the cylinder barrel has a uniform thickness.

12. The hydraulic cylinder of claim 7 where the tapered outer surface of the rod gland has no threads.

13. A rod gland assembly for a hydraulic cylinder barrel having a flared end, a tapered inner surface and an inner annular groove in the flared end of the hydraulic cylinder barrel, the rod gland assembly comprising:

a rod gland;

a locking ring capable of compressing to decrease the circumference of the locking ring, the locking ring being compressed for insertion into the flared end of the hydraulic cylinder barrel and being expanded to seat in the inner annular groove in the flared end of the hydraulic cylinder barrel the compressible locking ring having a first portion with a substantially circular cross section;

the tapered inner surface of the hydraulic cylinder barrel preventing movement of the rod gland farther into the hydraulic cylinder barrel and the locking ring, when expanded to seat in the inner annular groove, preventing movement of the rod gland out of the hydraulic cylinder barrel.

14. The rod gland assembly of claim 13 wherein the rod gland has a first outer surface of greatest circumference, a second outer surface of lesser circumference and a tapered outer surface between the first outer surface and the second outer surface.

15. The rod gland assembly of claim 13 wherein the compressible locking ring has a second portion with a substantially rectangular cross section.

* * * * *